United States Patent [19]

Heyman et al.

[11] Patent Number: 4,622,698

[45] Date of Patent: Nov. 18, 1986

[54] DISPOSABLE BIB

[76] Inventors: Eleanor Heyman, 23288 Morningside Dr.; Lois Nager, 22411 Twyckingham, both of Southfield, Mich. 48034

[21] Appl. No.: 724,840

[22] Filed: Apr. 19, 1985

[51] Int. Cl.[4] ..... A41D 27/12

[52] U.S. Cl. ..... 2/49 R

[58] Field of Search ..... 2/49 R, 48

[56] References Cited

U.S. PATENT DOCUMENTS

| | | | |
|---|---|---|---|
| 3,299,440 | 1/1967 | Grable | 2/49 R |
| 3,416,157 | 12/1968 | Marder et al. | 2/49 |
| 3,654,629 | 4/1972 | Crisman et al. | 2/49 R |
| 3,793,644 | 2/1974 | Kellner | 2/49 R |
| 3,916,447 | 11/1975 | Thompson | 2/49 R |
| 3,999,221 | 12/1976 | Hannigan | 2/49 R |
| 4,050,099 | 9/1977 | David | 2/49 R |
| 4,186,443 | 2/1980 | Britzman | 2/49 R |
| 4,306,316 | 12/1981 | Klepfer | 2/49 R |
| 4,423,523 | 1/1984 | Bodner et al. | 2/49 R |

*Primary Examiner*—Doris L. Troutman
*Attorney, Agent, or Firm*—Alex Rhodes

[57] ABSTRACT

A disposable bib for protecting the person and clothing of a user having parallel side margins, a concave upper margin, a convex lower margin, a pair of spaced apart upwardly extending straps adjoining the ends of the upper margin and an adhesive means at the end portions of the upwardly extending straps for retaining the bib to the user. The bib is supplied singularly or as part of a roll of perforated detachable bibs and is made without waste from a continuous strip of absorbent non-woven paper like material, coated on one side with a moisture repellant substance. The lower portions of the side margins are recessed inwardly whereby the upwardly extending straps of an adjoining bib in the roll of detachable bibs is formed from the material stock corresponding to the recessed portions of the bib. The upwardly extending straps and adhesive means thereon may be used for retaining the bib to the user's neck or alternatively for retaining the bib to the user's shoulders.

8 Claims, 13 Drawing Figures

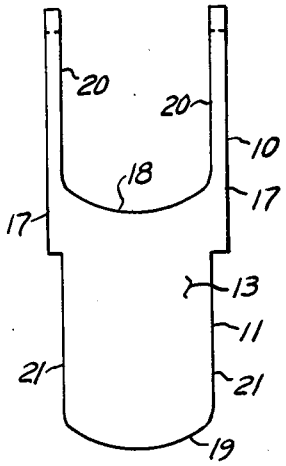
FIG.1
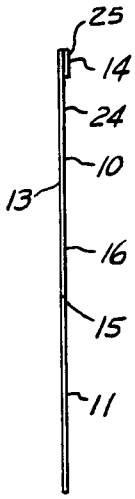
FIG.2
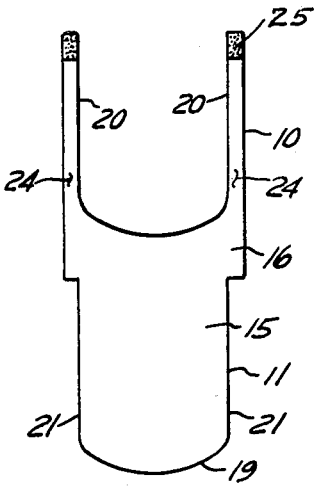
FIG.3
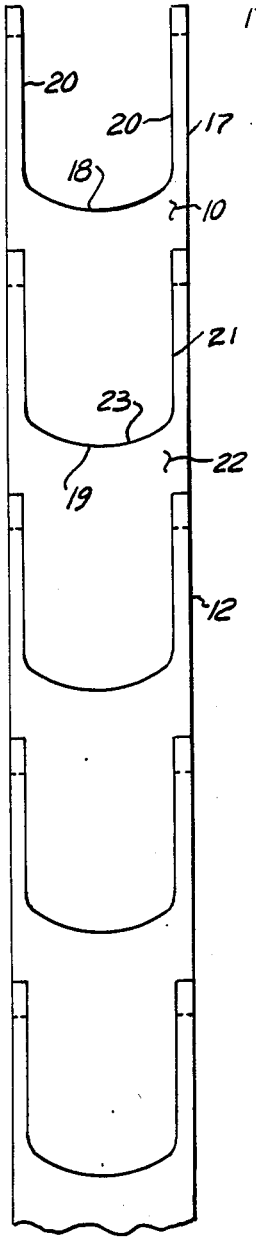
FIG.4
FIG.5
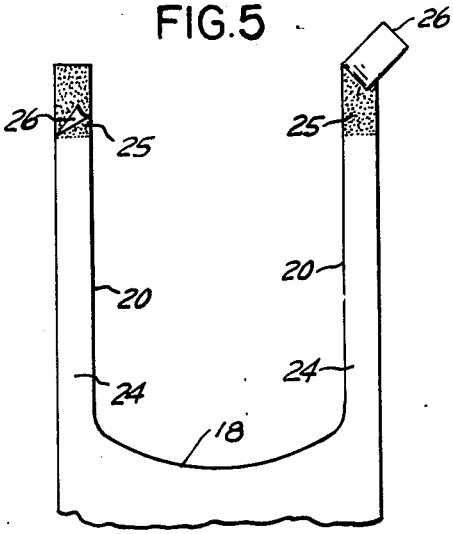
FIG.6
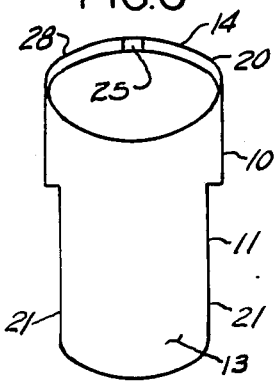
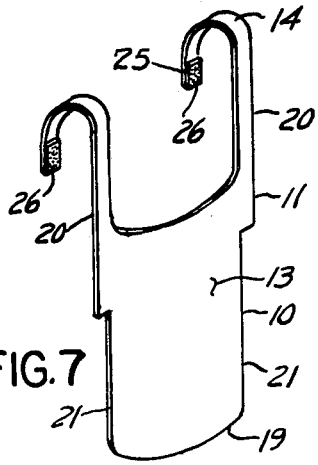
FIG.7
FIG.8
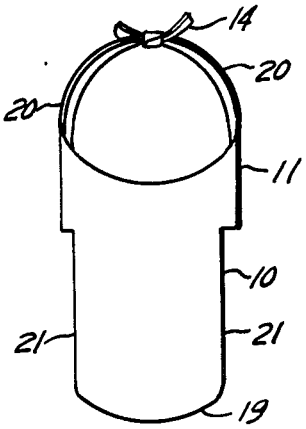

DISPOSABLE BIB

BACKGROUND OF THE INVENTION

A variety of bibs exist in the prior art whose primary object is to provide a disposable means for protecting the person and clothing of infants, restaurant patrons and the aged during eating. They are typically cut from thin sheets of non-woven paper or plastic materials. The principal differences which distinguish bibs of the prior art are the application of single or multi-layer materials and the particular means for retaining them on a user.

Heretofore, some bibs have been retained by continuous yoke shaped neck straps. Because of variations in head size, this practice has not permitted the use of a common bib for the complete range of user sizes. Other bibs have been adhesively retained to the front side of a user's body or clothes. This practice has not provided adequate retention to the user's clothes nor provided comfort when directly attached to the user's skin of a user when clothing has not been present for making an adhesive bond. Additionally, in most instances all material stock has not been utilized in making prior art bibs causing some of the material stock to be discarded during the manufacturing process. Marketing tests have shown that the commercial success of this kind of product is largely dependent on price and that a low price can significantly increase sales.

SUMMARY OF THE INVENTION

The present invention is related to disposable bibs and more particularly to a disposable bib, having improved means for retaining the bib on a user, which may be marketed as part of a roll of detachable bibs. The new and improved bib comprises a thin sheet of an absorbent non-woven paper or plastic material having parallel side margins, a concave upper margin, a concave lower margin, a pair of parallel upwardly extending straps and adhesive means for retaining the bib to the torso of a user. The adhesive means permit alternate attachments of the bib directly to the body or clothes of the user.

It is a primary object of the present invention to provide a disposable bib having improved means for attaching the bib to a user.

It is another object in addition to the foregoing object to provie a disposable bib having alternate means for attaching the bib to a user.

It is another object in addition to the foregoing objects to provide a disposable bib which will accommodate a wide range of user sizes.

It is another object in addition to the foregoing object to provide an inexpensive and convenient disposable bib which is adaptable to a wide range of users.

It is another object in addition to the foregoing objects to utilize all of the material stock in making disposable bibs.

Additional objects, features and benefits will be apparent from the following detailed description and accompanying drawings of the invention.

BRIEF DESCRIPTION OF THE DRAWING

FIG. 1 is a frontal view of a disposable bib having neck straps only for mounting the bib on a user.

FIG. 2 is a side elevational view of the disposable bib.

FIG. 3 is a rear view of the disposable bib.

FIG. 4 is a frontal view of a strip of several disposable bibs of the embodiment shown in FIG. 1.

FIG. 5 is a fragmentary view of FIG. 3 drawn to an enlarged scale.

FIG. 6 is a frontal perspective view showing one means for mounting the disposable bib on a user.

FIG. 7 is a frontal perspective view showing another means for mounting the disposable bib on a user.

FIG. 8 is a frontal perspective view showing still another means for mounting the disposable bib on a user.

DESCRIPTION OF THE PREFERRED EMBODIMENT

Figure 9:
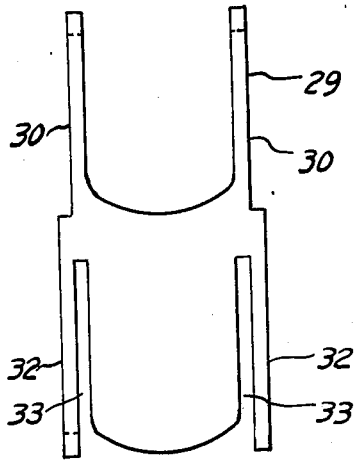
FIG. 9 is a frontal view of an alternate embodiment of the disposable bib having both neck and waist straps for mounting the bib on a user.
Figure 10:
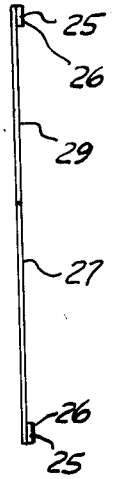
FIG. 10 is a side elevational view of the alternate embodiment.
Figure 11:
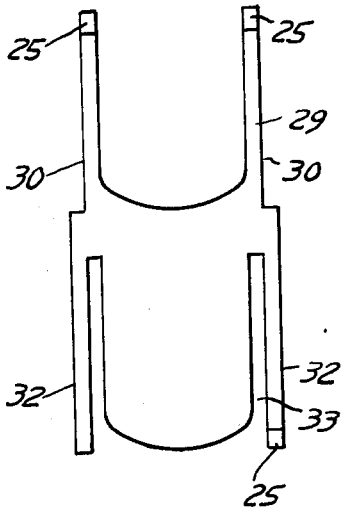
FIG. 11 is a rear view of the alternate embodiment.
Figure 12:
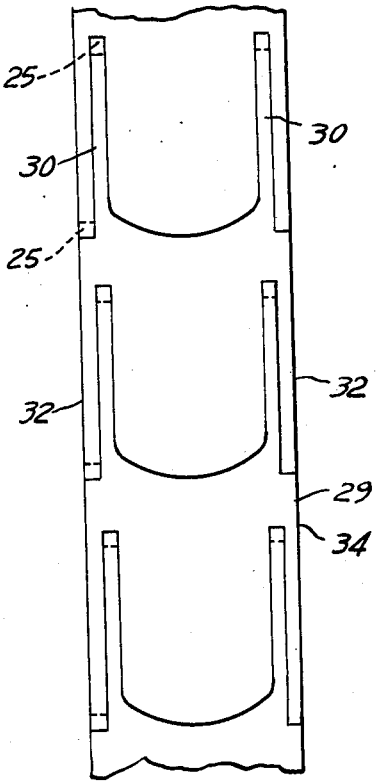
FIG. 12 is a frontal view of a strip of several disposable bibs of the alternate embodiment.

Referring now to the drawings wherein like numerals refer to like and corresponding parts throughout the several views, the present invention of a disposable bib 10 shown in FIGS. 1 through 8, inclusive, comprises a thin sheet 11 cut from a continuous strip 12 of thin absorbent open fiber non-woven paper like material and a means 14 for attaching the bib 10 to a user. The absorbent paper like material 11 is preferably coated or laminated on one side 15 only with a moisture repellant material 16 and may be supplied to a user singularly or as part of a perforated roll 12 of detachable bibs 10.

As shown in FIG. 1, the bib 10 has parallel side margins 17, a concave upper margin 18 which forms a cutout for the user's neck and a convex lower margin 19. Adjoining the end portions of the upper margin 18 of the bib 10 is a pair of spaced apart parallel straps 20 which extend upwardly for retaining the bib 10 to a user.

Referring again to FIG. 1, the lower portions of the side margins 17 are recessed inwardly. From FIG. 4 it will be observed that the recesses 21 of the lower portions of the side margins 17 correspond to the material stock from which the upwardly extending parallel straps 20 of an adjoining bib 22 are derived and the convex lower margin 19 corresponds to the concave upper margin 23 of the adjoining bib 22. Thus, one benefit of the invention is that all of the material stock is used without waste in making the invention.

On the rear surface 24 of each distal end portion of the upwardly extending straps 20 is a small segment of a double sided pressure sensitive adhesive coated tape 25. As an alternative to the double sided tape 25, a coating of a pressure sensitive adhesive may be directly applied to the straps 20. Covering each outward facing portion of the double sided adhesive tape 25 is a thin peelable layer of material 26, such as, a wax coated paper or a plastic sheet material.

One feature of the invention is that the upper straps 20 can be used to retain the bib 10 on a user's neck or alternatively to the user's shoulders. Another feature is that the adhesive means 25 for attaching the bib 10 need never be applied directly to the user's skin. Still another feature is that a single size will accomodate a range of user sizes.

With reference to FIG. 6, when the user's torso is bare, to avoid the discomfort of adhesively attaching the straps 20 to the user's skin, the bib 10 is supported on the user's neck by forming the upper straps 20 into the shape of a loop and thence connecting the ends of the straps 20. This is accomplished by orienting the moisture absorbing side 13 outwardly on the user's torso and thence passing each of the straps 20 around the neck of the user, thence removing the layer 26 of peelable material from one segment of adhesive tape 25 and thence overlapping and joining together the ends of the straps 20 by pressing together the exposed adhesive surface of the tape 25 against the end portion of the other strap 28. Alternatively, the ends of the straps 20 may be joined by tying them together in a knot as shown in FIG. 8.

Referring now to FIG. 7, when the torso of the user is clothed, it is quicker and more convenient to attach the bib to the user's clothing by removing both of the peelable layers 26 of material from the upwardly extending straps 20, with the moisture absorbing side 13 of the bib 10 facing outwardly, placing the bib 10 against the front of the user's torso, passing the straps 20 over the shoulders of the user and pressing the segments of adhesive tape 25 at the distal end portions of the straps 20 against the rear portion of the user's clothing.

Referring now to FIGS. 9 through 12, inclusive, an alternate embodiment 29 of our invention is disclosed therein which further comprises a pair of downwardly extending straps 32 for additional retention of the bib 29 to the waist of a user. The upper straps 30 of the alternate embodiment 29 are recessed inwardly to provide the material stock for the lower straps 32 of an adjacent bib 34. Inward of each of the lower straps 32 is a recess 33 which provides material stock for the upper straps 30 of the adjacent bib 34. It will be observed from FIG. 12 that the entire material stock without waste is used in making the invention.

On the moisture repellant surface 27 of the distal end portion of each upper strap 30 and one lower 32 strap is a small segment of a double sided pressure sensitive adhesive coated tape 25 and a thin peelable layer of material 26, such as, wax coated paper or plastic sheet material covering the outward facing surface of the pressure sensitive adhesive.

Figure 13:
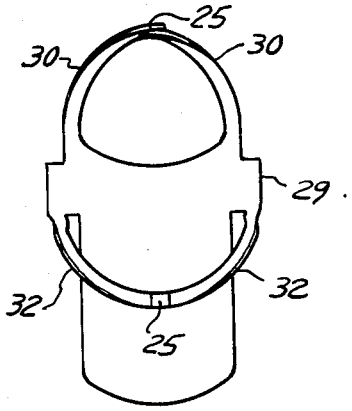
FIG. 13 is a rear perspective view showing a means for mounting the alternate embodiment.

With reference to FIG. 13, the upper straps 30 mounted to the user by connecting their distal end portions to form a loop in the manner shown in FIGS. 6 and 8 or in the manner shown in FIG. 7. The downward extending lower straps 32 are passed around the user's waist and joined together as shown by the pressure sensitive adhesive tape segment 25 or by tying their ends together (not shown).

From the foregoing description and accompanying drawings it will be appreciated that our invention provides an inexpensive and effective disposable bib cut without waste from a continuous strip of sheet material. Moreover, our invention provides a versatile means for retaining a bib to a range of users heretofore not available.

Athough but two embodiments of our invention have been described herein, it will be appreciated that other embodiments can be derived by changes in shape and other details without departing from the spirit thereof.

We claim:

1. Disposable bib for protecting the person and clothing of a user comprising in combination a thin sheet of coated absorbent material having a moisture repellant coating on one side of said absorbent sheet, parallel side margins, a concave upper margin, a convex lower margin and a pair of spaced apart parallel upwardly extending straps adjoining the end portions of the upper margin.

2. Disposable bib recited in claim 1 further comprising an adhesive means on the distal end portion of one upwardly extending strap.

3. Disposable bib recited in claim 1 further comprising a small segment of a double sided adhesive coated tape applied to each distal end portion on the same uncoated absorbent side of said upwardly extending straps, said straps extending to a point above the adjoining end portions of the concave margins such that the straps can be passed over the shoulders of the user and adhesively attached to a rear portion of the user's clothing.

4. Disposable bib recited in claim 3 further comprising a pressure-sensitive adhesive coating on each distal end portion on the same side of said upwardly extending straps.

5. Disposable bib recited in claim 4 further comprising a thin layer of peelable material covering the pressure-sensitive adhesive coating on each distal end portion of the upwardly extending straps.

6. Disposable bib for protecting the person and clothing of a user comprising in combination a thin sheet of absorbent material having parallel side margins, a concave upper margin, a convex lower margin, a pair of spaced parallel upwardly extending straps recessed inwardly from the side margins and adjoining the end portions of the upper margins for mounting the upper portion of the bib to the user's neck and a pair of downwardly extending straps, formed by recesses inwardly of said downwardly extending straps, in the lower portions of said sheet for mounting the lower portion of the bib to the user's waist.

7. Disposable bib recited in claim 6 further comprising a small segment of a double sided adhesive coated tape applied to each distal end portion of each upwardly extending strap and the distal end portion of one of the downwardly extending straps.

8. Disposable bib for protecting the person and clothing of a user comprising in combination:

(a) a thin sheet of absorbent material having parallel side margins, a concave upper margin, a convex lower margin, a pair of spaced apart parallel upwardly extending straps adjoining the end portions of the upper margin for mounting the upper portion of the bib to the user's neck and a pair of downwardly extending straps formed by recesses inward of said downwardly extending straps for mounting the lower portion of the bib to the user's waist;

(b) a moisture repellant coating on one side of said absorbent sheet; and (c) a small segment of a double sided adhesive coated tape applied to the distal end portion of each upwardly extending strap.

* * * * *